US005198044A

United States Patent [19]

Colijn et al.

[11] Patent Number: 5,198,044

[45] Date of Patent: Mar. 30, 1993

[54] COPPER ALLOY AND PROCESS FOR ITS PREPARATION

[75] Inventors: Jeroen Colijn; Gerrit J. H. Mol; Piet Krahmer; Allan D. Steele, all of Arnhem, Netherlands

[73] Assignee: Shell Research Limited, United Kingdom

[21] Appl. No.: 682,212

[22] Filed: Apr. 9, 1991

[30] Foreign Application Priority Data

Apr. 20, 1990 [GB] United Kingdom ..... 9008957

[51] Int. Cl.[5] ..... B22F 1/00

[52] U.S. Cl. ..... 148/514; 148/522; 148/536; 148/553; 148/554; 148/679; 148/685; 148/686

[58] Field of Search ..... 148/513, 514, 522, 536, 148/553, 554, 679, 685, 686

[56] References Cited

U.S. PATENT DOCUMENTS 3,937,638 2/1976 Plewes .
4,373,970 2/1983 Scorey et al. .
4,525,325 6/1985 Livak ..... 420/473

FOREIGN PATENT DOCUMENTS 1379261 1/1975 United Kingdom .
1472939 5/1977 United Kingdom .
1599392 9/1981 United Kingdom .

OTHER PUBLICATIONS

Int. J. of Powder Metallurgy, 1986, vol. 22, No. 1, pp. 53–58.

*Primary Examiner*—John P. Sheehan

[57] ABSTRACT

Process for the preparation of a substantially homogeneous alpha phase copper-nickel-tin alloy comprising copper and 4–18% by weight of nickel and 3–13% by weight of tin, comprising atomizing a molten alloy having the before-indicated composition and collecting atomized particles on a collecting surface in such a way that solid collected material is obtained having a temperature, of at least 700° C., followed by quick cooling of the collected material to a temperature below 300° C.

The alloy thus obtained may be hardened, preferably after shaping, by spinodal decomposition.

25 Claims, No Drawings

COPPER ALLOY AND PROCESS FOR ITS PREPARATION

The invention relates to a process for the preparation of a substantially homogeneous alpha phase copper-nickel-tin alloy and to the hardening and/or strengthening by spinodal decomposition of a thus prepared alloy, as well as to the substantially homogeneous alpha phase copper-nickel-tin alloy itself and the hardened and/or strengthened alloy made therefrom.

Copper-nickel-tin alloys have been known for many years to exhibit substantial age-hardening by spinodal decomposition, making them potentially attractive for various electrical and electronic applications as electrical springs, switches and high performance electrical connections, especially those requiring an exceptional combination of strength, thermal stability, formability and corrosion resistance. They have received wide attention as potential substitutes for copper-beryllium and phosphorbronze alloys in applications which require good electrical conductivity in combination with good mechanical strength and ductility.

One of the alloy conditions which should be fulfilled to take full advantage of the spinodal behaviour is that prior to the spinodal ageing treatment, the alloying elements have to be substantially homogeneously distributed in the matrix. However, by straight forward conventional production of the alloy, e.g. ingot casting, this criterion is not met due to segregation of alloying elements during the production. From U.S. Pat. No. 3,937,638 it was known that the above mentioned alloys could be prepared by making a copper-nickel-tin melt of the desired composition, and casting the melt into an ingot by conventional casting techniques. The cast ingot is homogenised by a high temperature treatment and thereafter cold worked, in an attempt to break up the cored structure which results during casting. The material is then worked to final dimensions, annealed, quenched and aged, generally with cold working between quenching and aging.

Commercial application of the above described technique, however, did not appear to be possible, since during large scale preparations elemental segregation occurred, especially tin segregation at the grain boundaries, which has a detrimental effect on the strength and ductility of the alloy. This segregation could not easily be eliminated by subsequent thermomechanical processing of the alloy.

An improved process for the preparation of the above mentioned copper-nickel-tin alloys is described in U.S. Pat. No. 4,373,970. A molten copper-nickel-tin alloy is atomized into very small droplets which are rapidly solidified, whereafter the alloy powder is mechanically roll-compacted into a continuous green strip having structural integrity and sufficient porosity to be penetrated by a reducing atmosphere. The strip is subsequently sintered in a reducing atmosphere, cooled at a rate to prevent age hardening and embrittlement, rolled to substantially fully dense final gauge and finally annealed and quenched to produce a fully dense, substantially homogeneous alpha phase material.

It will be appreciated that the above described process is highly laborious, and thus relatively expensive, due to the large number of steps which have to be carried out. It has to be remarked that in order to produce high quality alloys several cold rolling and annealing steps are necessary.

It has now been found that substantially homogeneous alpha phase copper-nickel-tin alloys may be prepared in a simple process by atomizing the molten alloy and collecting the atomized particles on a collecting surface in such a way that solid collected material is obtained at a relatively high temperature, followed by quick cooling of the collected material to a relatively low temperature. Collecting the atomized particles at high temperature followed by quick cooling prevents the occurrence of other crystal phases such as brittle gamma phases and/or spinodal phases. Thus it is possible to prepare copper-nickel-tin alloys in all kinds of shapes, as sheets, strips, blocks, bars, rods, ribbon, band and wire, having an unaged, equiaxed grain structure of substantially all alpha, face-centered-cubic phase with a substantially uniform dispersed concentration of tin and substantial absence of tin segregation.

The present invention therefore relates to a process for the preparation of a substantially homogeneous alpha phase copper-nickel-tin alloy comprising copper and 4–18% by weight of nickel and 3–13% by weight of tin, comprising atomizing a molten alloy having the before-indicated composition and collecting atomized particles on a collecting surface in such a way that solid collected material is obtained having a temperature of at least 700° C., followed by quick cooling of the collected material to a temperature below 300° C., preferably below 200° C.

The nickel to tin weight ratio in the molten copper-tin-nickel alloy is preferably between 3:1 to 4:3. The weight percentages in this specification are based on the weight of the total composition.

Atomizing liquid metals or alloys and collecting the atomized particles on a collecting surface is known from for instance British patents 1,379,261, 1,472,939 and 1,599,392. In these patents processes are described in which a molten stream of metal or alloy is atomised by the impact of a high velocity atomising gas. Thus a spray of fine, molten metal particles is obtained from which heat is extracted in flight by the relatively cold gas jets so that the metal particles may be obtained which are partly-solid/partly-liquid at the moment of impacting the deposition substrate. On impacting the substrate surface the particles deform, coalesce and build up to form a coherent mass of deposited metal which has a finely divided grain structure. The obtained mass of collected metal or alloy is cooled to ambient temperature without any special measures, and thus at relatively slow cooling rates.

The collecting surface to be used in the process of the present invention is suitably a simple plain surface. Other forms, for instance rotating cylinders, pre-shaped forms etc., may be used as well. Preferably thin sheets are used, for instance thin sheets of mild steel or a thin sheet of copper-nickel-tin may be used. The collecting surface, especially in the case of thin sheets, is preferably insulated underneath to prevent the occurrence of cold-porosity in the sprayed product. The collecting surface is usually movable with respect to the spray nozzle.

The amounts of molten alloy to be spray-deposited may be varied within wide ranges. In the case of batch-production suitably amounts of at least 1 kg are used, more suitably at least 5 kgs. Preferably at least amounts of 10 kgs are used. The upper limit is suitably several hundreds of kgs of alloy, preferably 300 kgs. In case larger amounts are to be spray-deposited, continuous operation may be used.

In a preferred embodiment of the invention the solid collected material is obtained at a temperature above 750° C., more preferably above 800° C., still more preferably between 850° and 950° C.

In another preferred embodiment of the present invention the temperature of the collected material after quick cooling is below 150° C., more preferably between 20° and 100° C.

The cooling rate of the collected mass should be such that all the collected material remains in the alpha phase. Suitably the cooling rate of the collected material is at least 100° C. per minute, preferably at least 200° C. per minute, between the collection temperature and a temperature between 550° C. and 450° C., and at least 20° C. per minute, preferably at least 30° C. per minute, between the temperature between 550° C. and 450° C. and the ultimate temperature. More preferably the cooling rate of the collected material is at least 300° C. per minute between the relative high temperature and the temperature between 550° C. and 450° C., and at least 40° C. per minute between the temperature between 550° C. and 450° C. and the ultimate temperature.

The alloys to be used in the process of the present invention may optionally contain small amounts of additives, for example iron, magnesium, manganese, molybdenum, niobium, tantalum, vanadium, zirconium, and mixtures thereof. The additives may be present in amounts up to 1%, suitably up to 0.5%. Further, small amounts of natural impurities may be present. Small amounts of other additives may be present such as aluminium, chromium, silicon and zinc, if desired. The presence of the additional elements may have the beneficial effect of further increasing the strength of the resulting alloy, as well as accentuating particularly desired characteristics. In a preferred embodiment of the invention, some magnesium is added to the molten alloy in order to reduce the oxygen content of the alloy. Magnesium oxide is formed which can be removed from the alloy mass. Suitably up to 1% magnesium is used. For the preparation of the alloys metals with a purity of 99.0% or more are used, suitably 99.5% or more and preferably 99.9% or more.

The amount of copper in the alloy is suitably more than 65% by weight, preferably between 69 and 95% by weight, more preferably about 77% by weight.

The collection rate of the alloy is suitably between 1 and 250 kg/min, preferably between 5 and 50 kg/min, more preferably between 15 and 30 kg/min. The gas to metal weight ratio is chosen in such a way that sufficient cooling is obtained. Suitably the gas to metal weight ration is between 0.01 and 2.0, preferably between 0.1 and 0.7, more preferably between 0.2 and 0.5. As atomizing gas all inert gasses may be used. Preferably nitrogen or a group VIII inert gas is used. The best results are obtained when using nitrogen as atomizing gas.

The cooling of the spray deposited alloy mass may be performed using all possible techniques, provided that a sufficient cooling rate is obtained to prevent formation of crystal phases other than the alpha phase. Suitably, gas quenching may be used in which (cold) gas is used as cooing medium, Suitable quenching gases are inert gases as nitrogen and the group VIII inert gases. Further, quenching with water may be used. In this case quenching may be carried out by spraying water over the collected mass or, preferably, by immersing the spray deposited body in water. Another suitable way of cooling may be obtained by passing the collected material through cooled rollers. Cooled rollers may be used immediately after spray depositing, for instance by spray depositing the molten alloy directly on one of the rolls or by spray depositing on a sheet which is thereafter fed to the rolls, or at a later stage, for instance after having collected all the molten alloy mass and having it kept for a longer period at a temperature above 700° C.

The spinodal hardening of the obtained alpha phase copper-nickel-tin alloys prepared according to the process of the present invention may be carried out by techniques known in the art. Suitably, the hardening is carried out by heating the alloy to a temperature between 250° and 450° C., preferably between 300° and 400° C. for a period of at least 15 minutes, preferably between 1 and 6 hours. The hardening is carried out in such a way that at least 50% of the alloy has been transferred into the spinodal phase, preferably 70%, more preferably 90%. The hardening is preferably carried out after shaping the alloy into its desired form, as shaping after substantial hardening is almost impossible. It is observed that the effect of cold working usually results in a shortened hardening time. Usually the spray deposited alloy masses are machined before cold working, e.g. rolling.

The invention is illustrated by the following examples.

EXAMPLE 1

Molten copper-nickel-tin alloy at a temperature of 1250° C. was prepared by melting 4N purity copper, nickel and tin in the proportions by weight 18% Ni, 8% Sn, balance copper, in an induction furnace under an argon atmosphere. The molten alloy was cast into steel crucibles and samples of the cooled billets were taken for metallurgical examination. The billet material was found to have a coarse microstructure and exhibited pronounced macro-segregation of tin.

EXAMPLE 2

Copper-nickel-tin alloy (4 kg) of similar composition to the material used in Example 1 was melted and spray deposited in sheet form. The temperature of the molten alloy was 1180° C. Nitrogen was used as atomizing gas (gas to metal weight ratio 0.3). Metal flow rate 21 kg/min. The temperature of the spray deposited mass was estimated to be between 850° and 950° C. Cold nitrogen gas (about 1 kg/min/kg) was used to quench the alloy to about 80° C. in about eight minutes. Metallurgical examination revealed that the spray-deposited alloy had a much finer microstructure and showed no indications of macro-segregation of either tin or nickel.

EXAMPLE 3

In the same was as descried in Example 1, a molten alloy of copper-nickel-tin was prepared containing 14% Ni, 9% Sn, balance copper. After casting in the same way as in Example 1, billets were obtained. The as-cast billet material was found to have a coarse microstructure with elemental segregation in evidence.

EXAMPLE 4

Copper-nickel-tin alloy (4 kg) of the composition as described in Example 3 was spray-deposited in the same way as described in Example 2. The resulting sheet alloy was found to have a fine microstructure free of large scale elemental segregation.

We claim:

1. Process for the preparation of a substantially homogeneous alpha phase copper-nickel-tin alloy comprising copper and 4–18% by weight of nickel and 3–13% by weight of tin, comprising atomizing a stream of molten alloy having the afore-mentioned composition by the impact of a high velocity atomizing gas, collecting atomized particles on a collecting surface in such a way that solid collected material is obtained having a temperature of at least 700° C. and cooling the collected material to a temperature below 300° C., at a cooling rate sufficiently rapid such that said solid collected material is substantially in the alpha phase.

2. Process according to claim 1, wherein quick cooling of the collected material is carried out to a temperature below 200° C.

3. Process according to claim 1, wherein the nickel to tin weight ratio in the copper-nickel-tin alloy is between 3:1 to 4:3.

4. Process according to claim 1, wherein the alloy further comprises small amounts of vanadium and/or zirconium.

5. Process according to claim 1, wherein the collected material is obtained at a temperature above 750° C.

6. Process according to claim 5 wherein the collected material is obtained at a temperature above 800° C.

7. Process according to claim 6 wherein the collected material is obtained at a temperature between 850° and 950° C.

8. Process according to claim 1, wherein the collected material is cooled to a temperature below 150° C.

9. Process according to claim 8, wherein the collected material is cooled to a temperature between 20° and 100° C.

10. Process according to claims 1, wherein the alloy is collected at a deposition rate of between 5 and 50 kg/min, using a gas to metal weight ratio between 0.1 and 0.7.

11. Process according to claim 10, wherein the deposition rate is between 15 and 30 kg/min and the gas to metal weight ratio is between 0.2 and 0.5.

12. Process according to claim 1, wherein as atomizing gas nitrogen is used.

13. Process according to claim 1, wherein the cooling rate of the collected material is at least 100° C. per minute between the collection temperature and a temperature between 550° C. and 450° C., and at least 20° C. per minute between the temperature between 550° C. and 450° C. and the ultimate temperature.

14. Process according to claim 13, wherein the cooling rate of the collected material is at least 300° C. per minute between the collection temperature and the temperature between 550° C. and 450° C., and at least 40° C. per minute between the temperature between 550° C. and 450° C. and the ultimate temperature.

15. Process according to claim 1, wherein cooling of the collected material is carried out by quenching with gas.

16. Process according to claim 15, wherein the gas is nitrogen.

17. Process according to claim 1, wherein cooling of the collected material is carried out by quenching the collected material in a liquid.

18. Process according to claim 17, wherein the liquid is water.

19. Process according to claim 1, wherein cooling is carried out by rolling of the collected material using one or more cooled rollers.

20. Process for the hardening of alpha phase cooper-nickel-tin alloys by phase conversion of at least part of the alloy having been collected and cooled according to claim 1 into the spinodal phase.

21. Process according to claim 20, wherein the hardening of the alpha phase copper-nickel-tin alloy is carried out after previous shaping of the alloy into its desired form.

22. Process according to claim 20, wherein the alloy is converted into the spinodal phase for more than 50%.

23. Process according to claim 22, wherein the alloy is converted into the spinodal phase for more than 70%.

24. Process according to claim 23, wherein the alloy is converted into the spinodal phase for more than 90%.

25. Process according to claim 20, wherein the phase conversion is obtained by heating to a temperature of between 250° and 450° C.

* * * * *